US008776302B2

(12) United States Patent
Baertschi et al.

(10) Patent No.: US 8,776,302 B2
(45) Date of Patent: Jul. 15, 2014

(54) ORAL CARE IMPLEMENT

(75) Inventors: Armin Baertschi, Winznau (CH); Martin Zwimpfer, Lucerne (CH); Robert Moskovich, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 751 days.

(21) Appl. No.: 12/201,027

(22) Filed: Aug. 29, 2008

(65) Prior Publication Data

US 2010/0050356 A1 Mar. 4, 2010

(51) Int. Cl.
*A46B 9/04* (2006.01)

(52) U.S. Cl.
USPC ..... 15/167.1; 15/143.1; 15/188

(58) Field of Classification Search
USPC ..... 15/22.1, 143.1, 167.1, 188, 110
See application file for complete search history.

(56) References Cited

U.S. PATENT DOCUMENTS

| | | | | |
|---|---|---|---|---|
| 828,393 | A | 8/1906 | Emerson | |
| 1,191,556 | A | 7/1916 | Blake | |
| 1,619,212 | A | 3/1927 | Neederman | |
| 2,040,245 | A | 5/1936 | Crawford | |
| 2,059,914 | A | 11/1936 | Rosenberg | |
| 2,088,839 | A | 8/1937 | Coney et al. | |
| 2,117,174 | A | 5/1938 | Jones | |
| 2,129,082 | A | 9/1938 | Byrer | |
| 2,139,246 | A | 12/1938 | Ogden | |
| 2,186,005 | A | 1/1940 | Casto | |
| 2,209,173 | A | 7/1940 | Russell | |
| 2,241,584 | A | 5/1941 | Cohen | |
| 2,471,855 | A | 5/1949 | Bird | |
| 2,637,870 | A | 5/1953 | Cohen | |
| 2,680,695 | A | 6/1954 | Judd | |
| 3,103,027 | A | 9/1963 | Birch | |
| 3,230,562 | A | 1/1966 | Birch | |
| RE26,403 | E | 6/1968 | Kutik | |
| 3,553,759 | A * | 1/1971 | Kramer et al. | 15/110 |
| D246,877 | S | 1/1978 | Kitzis | |
| D246,878 | S | 1/1978 | Kitzis | |
| 4,128,349 | A | 12/1978 | Del Bon | |
| 4,128,910 | A | 12/1978 | Nakata et al. | |
| 4,167,794 | A | 9/1979 | Pomeroy | |
| 4,277,862 | A | 7/1981 | Weideman | |

(Continued)

FOREIGN PATENT DOCUMENTS

| | | |
|---|---|---|
| CN | 3299615D | 10/2002 |
| CN | 1386456 A | 12/2002 |

(Continued)

OTHER PUBLICATIONS

International Search Report and Written Opinion of the International Searching Authority (EP) for corresponding International Application No. PCT/US2009/055471 mailed Jun. 18, 2010.

*Primary Examiner* — Monica Carter
*Assistant Examiner* — Michael Jennings
(74) *Attorney, Agent, or Firm* — Ryan M. Flandro

(57) ABSTRACT

An oral care implement has a head and a first tooth cleaning element. The first tooth cleaning element has a generally convex end surface such that dentifrice applied to the head is adapted to be directed towards a distal cleaning surface of the head. The oral care implement can also include a gum massaging element extending from a peripheral side of the head.

5 Claims, 9 Drawing Sheets

(56) References Cited

U.S. PATENT DOCUMENTS

| | | | | |
|---|---|---|---|---|
| 4,852,202 | A | 8/1989 | Ledwitz | |
| D306,523 | S | 3/1990 | Natali et al. | |
| 4,911,811 | A | 3/1990 | Mullaney, Jr. | |
| 5,040,260 | A * | 8/1991 | Michaels | 15/167.1 |
| 5,044,948 | A | 9/1991 | Vance, Sr. et al. | |
| D326,189 | S | 5/1992 | Brooks | |
| D333,918 | S | 3/1993 | Curtis et al. | |
| D334,472 | S | 4/1993 | Curtis et al. | |
| D334,473 | S | 4/1993 | Volpenhein et al. | |
| D342,160 | S | 12/1993 | Curtis et al. | |
| D342,161 | S | 12/1993 | Curtis et al. | |
| D342,162 | S | 12/1993 | Curtis et al. | |
| D343,294 | S | 1/1994 | Curtis et al. | |
| 5,324,129 | A | 6/1994 | Root | |
| 5,335,389 | A | 8/1994 | Curtis et al. | |
| 5,341,537 | A | 8/1994 | Curtis et al. | |
| D370,564 | S | 6/1996 | Moskovich | |
| 5,628,082 | A * | 5/1997 | Moskovich | 15/110 |
| D380,903 | S | 7/1997 | Moskovich | |
| 5,735,011 | A | 4/1998 | Asher | |
| 5,802,656 | A * | 9/1998 | Dawson et al. | 15/110 |
| D400,713 | S | 11/1998 | Solanki | |
| 5,836,033 | A | 11/1998 | Berge | |
| 5,842,487 | A | 12/1998 | Ledet | |
| 5,896,614 | A | 4/1999 | Flewitt | |
| 5,987,688 | A | 11/1999 | Roberts et al. | |
| D421,841 | S | 3/2000 | Achepohl et al. | |
| 6,041,467 | A | 3/2000 | Roberts et al. | |
| 6,041,468 | A | 3/2000 | Chen et al. | |
| D422,143 | S | 4/2000 | Beals et al. | |
| D425,306 | S | 5/2000 | Beals et al. | |
| 6,105,191 | A | 8/2000 | Chen et al. | |
| 6,142,777 | A | 11/2000 | Winston et al. | |
| D434,565 | S | 12/2000 | Bojar | |
| D434,908 | S | 12/2000 | Bojar | |
| 6,196,235 | B1 | 3/2001 | Kim | |
| D444,629 | S * | 7/2001 | Etter et al. | D4/130 |
| 6,276,021 | B1 * | 8/2001 | Hohlbein | 15/167.1 |
| 6,283,930 | B1 | 9/2001 | Purvis et al. | |
| D448,569 | S * | 10/2001 | Harris et al. | D4/104 |
| 6,311,358 | B1 | 11/2001 | Soetewey et al. | |
| D456,607 | S | 5/2002 | Carlucci et al. | |
| 6,389,634 | B1 * | 5/2002 | Devlin et al. | 15/110 |
| 6,463,618 | B1 | 10/2002 | Zimmer | |
| D466,303 | S * | 12/2002 | Saindon et al. | D4/104 |
| 6,571,417 | B1 | 6/2003 | Gavney, Jr. et al. | |
| D477,465 | S | 7/2003 | Reilly et al. | |
| 6,595,775 | B1 | 7/2003 | Berk et al. | |
| 6,599,048 | B2 | 7/2003 | Kuo | |
| 6,687,940 | B1 | 2/2004 | Gross et al. | |
| 6,704,965 | B2 | 3/2004 | Ale et al. | |
| 6,764,626 | B2 | 7/2004 | Phu et al. | |
| D494,765 | S | 8/2004 | Park | |
| 6,810,551 | B1 | 11/2004 | Weihrauch | |
| 6,817,054 | B2 | 11/2004 | Moskovich et al. | |
| 6,820,299 | B2 | 11/2004 | Gavney, Jr. | |
| 6,859,969 | B2 * | 3/2005 | Gavney et al. | 15/117 |
| D503,538 | S | 4/2005 | Desalvo | |
| 6,944,903 | B2 | 9/2005 | Gavney, Jr. | |
| 6,957,469 | B2 | 10/2005 | Davies | |
| 6,993,804 | B1 | 2/2006 | Braun et al. | |
| 7,047,589 | B2 | 5/2006 | Gavney, Jr. | |
| 7,047,591 | B2 | 5/2006 | Hohlbein | |
| 7,051,394 | B2 | 5/2006 | Gavney, Jr. | |
| 7,089,621 | B2 | 8/2006 | Hohlbein | |
| 7,168,125 | B2 | 1/2007 | Hohlbein | |
| 7,174,596 | B2 | 2/2007 | Fischer et al. | |
| 7,181,799 | B2 | 2/2007 | Gavney, Jr. et al. | |
| 7,210,184 | B2 | 5/2007 | Eliav et al. | |
| 7,213,288 | B2 | 5/2007 | Hohlbein | |
| D631,257 | S | 1/2011 | Bärtschi et al. | |
| 7,908,699 | B2 * | 3/2011 | Hohlbein et al. | 15/110 |
| 2001/0029639 | A1 * | 10/2001 | Seifert | 15/110 |
| 2002/0004964 | A1 * | 1/2002 | Luchino et al. | 15/167.1 |
| 2002/0124864 | A1 | 9/2002 | Gross et al. | |
| 2002/0152570 | A1 | 10/2002 | Hohlbein | |
| 2003/0033680 | A1 | 2/2003 | Davies et al. | |
| 2003/0196283 | A1 * | 10/2003 | Eliav et al. | 15/22.1 |
| 2004/0060135 | A1 * | 4/2004 | Gatzemeyer et al. | 15/22.1 |
| 2004/0154112 | A1 | 8/2004 | Braun et al. | |
| 2004/0168269 | A1 | 9/2004 | Kunita et al. | |
| 2005/0091773 | A1 * | 5/2005 | Gavney et al. | 15/117 |
| 2005/0102780 | A1 | 5/2005 | Hohlbein | |
| 2005/0188488 | A1 | 9/2005 | Moskovich et al. | |
| 2005/0193512 | A1 | 9/2005 | Moskovich et al. | |
| 2006/0000037 | A1 * | 1/2006 | Eliav et al. | 15/22.1 |
| 2006/0048323 | A1 * | 3/2006 | Rueb | 15/167.1 |
| 2006/0064827 | A1 | 3/2006 | Chan | |
| 2006/0107478 | A1 | 5/2006 | Boucherie | |
| 2006/0117508 | A1 * | 6/2006 | Hohlbein | 15/110 |
| 2006/0123574 | A1 | 6/2006 | Storkel et al. | |
| 2006/0230563 | A1 | 10/2006 | Gavney, Jr. | |
| 2006/0236477 | A1 | 10/2006 | Gavney, Jr. | |
| 2007/0056128 | A1 * | 3/2007 | Hohlbein et al. | 15/110 |
| 2007/0067933 | A1 | 3/2007 | Waguespack | |
| 2007/0110503 | A1 | 5/2007 | Glover | |
| 2007/0186364 | A1 | 8/2007 | Hohlbein | |
| 2008/0184511 | A1 * | 8/2008 | Brown et al. | 15/110 |
| 2008/0201884 | A1 * | 8/2008 | Vazquez et al. | 15/167.1 |
| 2008/0201885 | A1 * | 8/2008 | Moskovich | 15/167.1 |
| 2009/0025165 | A1 * | 1/2009 | Moskovich et al. | 15/167.1 |
| 2009/0151101 | A1 | 6/2009 | Bielfeldt et al. | |
| 2009/0255077 | A1 * | 10/2009 | Mori et al. | 15/167.1 |

FOREIGN PATENT DOCUMENTS

| | | | |
|---|---|---|---|
| CN | 3334797D | | 5/2003 |
| CN | 1426283 | A | 6/2003 |
| CN | 1121144 | C | 9/2003 |
| CN | 1124802 | C | 10/2003 |
| CN | 1131689 | C | 12/2003 |
| CN | 3406089D | | 12/2003 |
| CN | 1142736 | C | 3/2004 |
| CN | 3412770D | | 4/2004 |
| CN | 3433188D | | 7/2004 |
| CN | 3450190D | | 10/2004 |
| CN | 1181774 | C | 12/2004 |
| CN | 2662724 | Y | 12/2004 |
| CN | 1564665 | A | 1/2005 |
| CN | 3478636D | | 1/2005 |
| CN | 2684634 | Y | 3/2005 |
| CN | 3514164D | | 4/2005 |
| CN | 3509341D | | 5/2005 |
| CN | 1642457 | A | 7/2005 |
| CN | 2720886 | Y | 8/2005 |
| CN | 3525700D | | 8/2005 |
| CN | 1122479 | C | 9/2005 |
| CN | 1219479 | A | 9/2005 |
| CN | 1688227 | A | 10/2005 |
| CN | 3624922D | | 4/2006 |
| CN | 3647562D | | 6/2006 |
| CN | 2899569 | Y | 5/2007 |
| CN | 2907359 | Y | 6/2007 |
| DE | 8903911 | U1 | 5/1989 |
| DE | 4444243 | A1 | 12/1994 |
| DE | 40505658-0006 | | 4/2006 |
| DE | 102006016939 | A1 | 4/2006 |
| DE | 40505656-0006 | | 5/2008 |
| EP | 0360766 | A1 | 3/1990 |
| EP | 0 371 293 | B1 | 1/1996 |
| EP | 0 716 573 | B1 | 6/1996 |
| EP | 0 768 832 | B1 | 4/1997 |
| EP | 0 843 524 | B1 | 5/1998 |
| EP | 0 932 348 | B1 | 8/1999 |
| EP | 1181877 | A2 | 2/2002 |
| EP | 1 187 541 | B1 | 3/2002 |
| EP | 1 119 272 | B1 | 12/2002 |
| EP | 1 100 353 | B1 | 10/2003 |
| EP | 1350442 | A1 | 10/2003 |
| EP | 1 194 053 | B1 | 11/2003 |
| EP | 1289729 | B1 | 12/2003 |
| EP | 1 301 325 | B1 | 4/2004 |
| EP | 1482821 | | 12/2004 |
| EP | 1 253 839 | B1 | 7/2005 |

(56) References Cited

FOREIGN PATENT DOCUMENTS

| | | | |
|---|---|---|---|
| EP | 1 185 242 | B1 | 8/2005 |
| EP | 1567314 | B1 | 8/2005 |
| FR | 2 079 455 | | 11/1971 |
| GB | 605742 | | 7/1948 |
| GB | 2 345 019 | B | 7/2003 |
| JP | 1175940 | | 7/1989 |
| JP | 1175940 | | 3/1999 |
| JP | 2008154808 | A | 7/2008 |
| KR | 30-0303422 | | 7/2002 |
| KR | 10-2004-0017533 | | 2/2004 |
| KR | 30-0362655 | | 9/2004 |
| KR | 30-0394240 | | 10/2005 |
| KR | 30-0410728 | S | 4/2006 |
| KR | 30-0422513 | S | 8/2006 |
| RU | 52578 | | 6/2003 |
| RU | 58679 | | 3/2006 |
| RU | 60343 | | 1/2007 |
| WO | 9506420 | A1 | 3/1995 |
| WO | 9601578 | A1 | 1/1996 |
| WO | 9616571 | A1 | 6/1996 |
| WO | WO 97/20484 | A1 | 6/1997 |
| WO | 9805239 | A1 | 2/1998 |
| WO | 9805240 | A1 | 2/1998 |
| WO | 0076369 | A2 | 12/2000 |
| WO | 196088 | | 12/2001 |
| WO | 0206034 | A1 | 1/2002 |
| WO | WO 02/11583 | | 2/2002 |
| WO | WO03/055351 | A1 | 7/2003 |
| WO | WO 03/055361 | | 7/2003 |
| WO | 03075711 | A1 | 9/2003 |
| WO | 2004026074 | A1 | 4/2004 |
| WO | 2004043669 | | 5/2004 |
| WO | 2004071237 | A1 | 8/2004 |
| WO | 2006003598 | A1 | 1/2006 |
| WO | 2006/037065 | | 4/2006 |
| WO | 2006037065 | A1 | 4/2006 |
| WO | 2007053034 | | 5/2007 |

* cited by examiner

ORAL CARE IMPLEMENT

BACKGROUND OF THE INVENTION

The present invention pertains to an oral care implement such as a toothbrush with an enhanced cleaning head. An oral care implement such as a toothbrush is used to clean teeth by removing plaque and debris from surfaces of the teeth as well as cleaning gum tissue surrounding the teeth. Conventional toothbrushes typically have a head having tufts of bristles and may also have other types of cleaning structures. Conventional toothbrushes have a limited ability to retain dentifrice on the head for cleaning the teeth. During the brushing process, the dentifrice typically slips through the tufts of bristles and away from contact with the teeth. As a result the dentifrice often is spread around the mouth, rather than being concentrated on the contact of the bristles with the teeth. Therefore, the efficiency of the cleaning process is reduced.

The present invention seeks to overcome certain of these limitations and other drawbacks of the prior art, and to provide new features not heretofore available.

BRIEF SUMMARY OF THE INVENTION

The invention pertains to an oral care implement or toothbrush with a configuration of tooth cleaning elements to provide enhanced cleaning of teeth and gums via improved retention and delivery of dentifrice.

In one aspect of the invention, an oral care implement has a head and a tooth cleaning element having an end surface such that dentifrice applied to the head is adapted to be directed towards a distal cleaning surface of the head.

In another aspect of the invention, a first tooth cleaning element has a first side proximate a first side of the head and a second side proximate a second side of the head. A central region of the cleaning element is proximate a central region of the head and proximate the distal cleaning surface of the head.

In another aspect, the first tooth cleaning element includes a plurality of first tooth cleaning elements, each first tooth cleaning element having a generally convex end and basin such that dentifrice applied to the head is adapted to be directed towards the distal cleaning surface of the head. The plurality of first tooth cleaning elements are spaced along the head.

In yet another aspect, a central region of the first tooth cleaning element defines an uppermost portion of the distal cleaning surface of the head.

According to another aspect of the invention, the oral care implement has a second or central tooth cleaning element having a plurality of members arranged in confronting and spaced relation. The second cleaning element is positioned adjacent the first tooth cleaning element. The plurality of members cooperatively form a generally X-shaped member, wherein the plurality of members converge towards a central point. The central point is generally at a central region of the head. In one exemplary embodiment, a plurality of second tooth cleaning members are included.

In another aspect, the oral care implement has a plurality of third tooth cleaning elements, or side tooth cleaning elements, that are positioned along peripheral sides of the head. The first tooth cleaning element extends between the plurality of third tooth cleaning elements.

In another aspect, a prophy cup structure is positioned at a distal end of the head.

In yet another aspect, a curved tooth cleaning element is positioned at a proximal end of the head. The curved tooth cleaning element may include a plurality of curved tooth cleaning elements positioned in spaced relation at the proximal end of the head.

According to another aspect of the invention, the oral care implement has a gum massaging element extending from a peripheral side of the head and towards the distal cleaning surface of the head. In one exemplary embodiment, the gum massaging element extends from a peripheral side edge of the head. In a further exemplary embodiment, the gum massaging element has a pair of spaced tines. Distal ends of the tines are positioned below a distal end of the first tooth cleaning element. In addition, the gum massaging element may include a plurality of gum massaging elements positioned at opposite peripheral side edges of the head. Each gum massaging member has a pair of spaced tines.

In another aspect, the side tooth cleaning element is formed of a flexible resilient material so that the side tooth cleaning element can flex from a first position, through the pair of tines of the gum massaging member to a second position, and back to the first position.

In yet another aspect of the invention, the head may include a plurality of tooth cleaning elements including a side tooth cleaning element positioned on a side of the head. The side tooth cleaning element has a plurality of spaced tines. In one exemplary embodiment, the side tooth cleaning element has a pair of spaced tines wherein the element is generally V-shaped.

Other features and advantages of the invention will become apparent from the following description taken in conjunction with the following drawings.

DETAILED DESCRIPTION OF THE INVENTION

Figure 1:
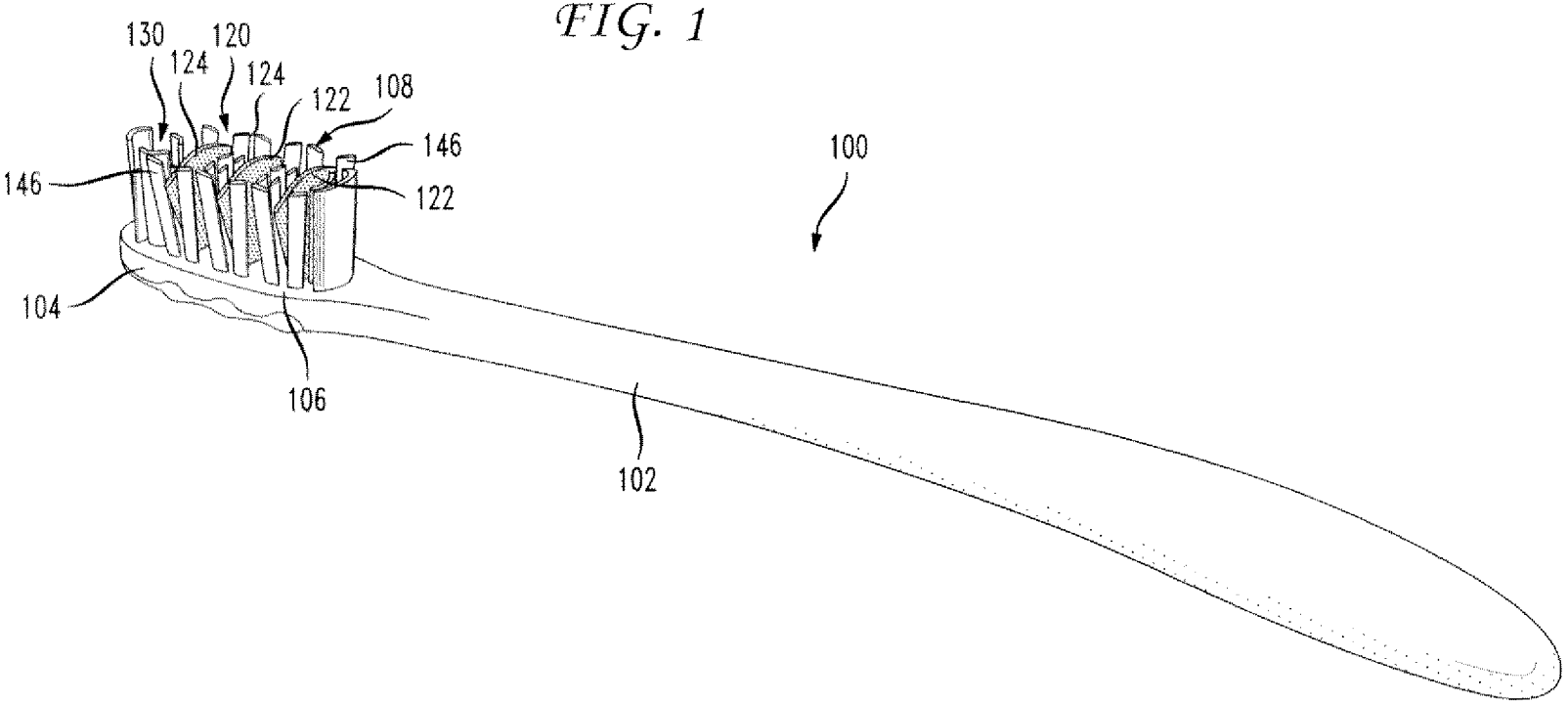
FIG. 1 is a perspective view of an oral care implement according to one or more aspects of an illustrative construction.

In the following description, the invention is discussed in terms of a toothbrush, but could be in the form of other oral care implements including a tissue cleansing implement. Further, it is understood that other embodiments may be utilized and structural and functional modifications may be made without departing from the scope of the present invention.

FIGS. 1-6 illustrate an oral care implement, such as a toothbrush, generally designated with the reference numeral 100. The toothbrush 100 generally includes a handle 102 and a head 104. The toothbrush 100 generally has a longitudinal axis L, which may also be considered a longitudinal axis L of the head 104.

The handle 102 is generally an elongated member that is dimensioned so that a user can readily grip and manipulate the toothbrush 100. The handle 102 may be formed of many different shapes, lengths and with a variety of constructions. The handle 102 may have a neck portion directly adjacent to the head 104. In one construction, the handle 102 is integrally formed with the head 104 although other attachment configurations are possible.

The head 104 generally includes a support member 106 and a variety of different tooth cleaning elements 108 positioned at various locations on the head 104. Each cleaning element 108 will be described in greater detail below. The support member 106 is typically integrally formed with the handle 102 and supports the various tooth cleaning elements 108. As further shown in FIG. 3, the head 104 has a first peripheral side 110 and a generally opposed second peripheral side 112. The head 104 has a central region 114 generally between the peripheral sides 110, 112. The head 104 further has a distal end 116 and a proximal end 118. Finally, the head 104 has a distal cleaning surface 120 (FIGS. 1-2) generally defined by distal ends of the various tooth cleaning elements 108 supported by the head 104.

Figure 2:
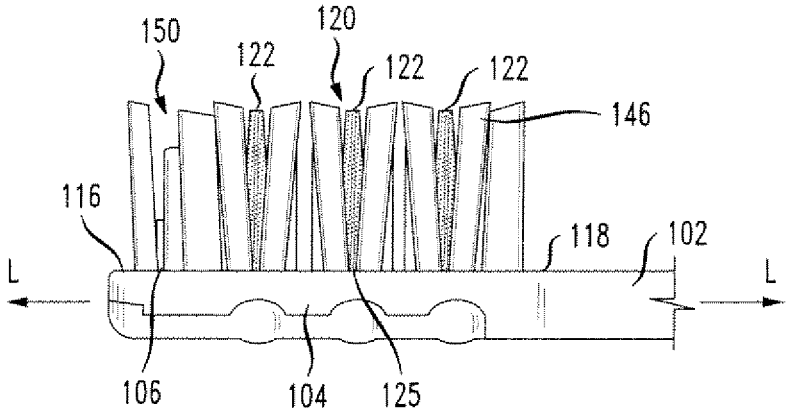
FIG. 2 is a partial front view of the oral care implement shown in FIG. 1.
Figure 3:
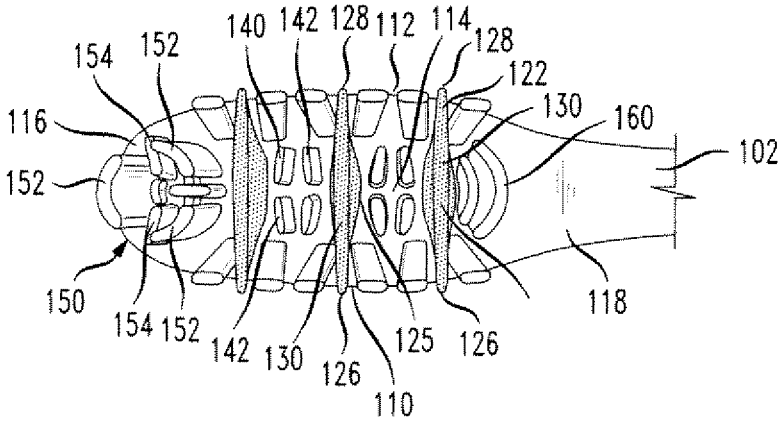
FIG. 3 is a partial top view of the oral care implement shown in FIG. 1.

As further shown in FIGS. 1-5, the oral care implement 100 has a first tooth cleaning element 122 that is generally fan-shaped. The first tooth cleaning element 122 has a generally convex end surface 124 that curves outwardly. The first tooth cleaning element 122 has a first side 126 proximate the first side 110 of the head 104 and a second side 128 proximate the second side 112 of the head 104. A central region 130 of the end surface 124 is proximate the central region 114 of the head 104. In addition, the central region 130 of the end surface 124 assists in defining the distal cleaning surface 120 of the head. The central region 130 generally represents an uppermost portion of the distal cleaning surface 120 of the head 104. The convex end surface 124 is positioned generally transverse to the longitudinal axis L. The first tooth cleaning element 122 has a base 125 connected to the head 104 wherein the base 125 may be flared outwardly as shown in FIG. 3 to provide additional support. The base 125 has a smaller lateral dimension (from first side 110 to second side 112) than the lateral dimension at the distal end of the first tooth, cleaning element 122. As shown in one exemplary embodiment, the first tooth cleaning element 122 includes a plurality of tooth cleaning elements 122 wherein each cleaning element 122 has the generally convex end surface 124 such that dentifrice applied to the head 104 is adapted to be directed towards the distal cleaning surface 120 of the head 104. In one construction, there are three first tooth cleaning elements 122 spaced along the head 104 and along the longitudinal axis L. As further shown in FIGS. 1-3, the central regions 130 of the convex end surfaces 124 of the cleaning elements 122 define the uppermost portion, of the distal cleaning surface 120 of the head 104.

FIGS. 1-3 further show additional tooth cleaning elements 108. In a further construction, the head 104 supports a second tooth cleaning element 140 in the form of a central tooth cleaning element 140. The central tooth cleaning element 140 has a plurality of members 142 that are arranged in confronting and spaced relation. In one construction, the members 142 are angled to form an outer periphery of the element 140. Other configurations are also possible. The tooth, cleaning element 140 is a plurality of tooth cleaning elements 140 in an exemplary embodiment. Each tooth cleaning element 140 is positioned generally in the central region 114 of the head 104 between the first tooth cleaning elements 122. The structure of the central tooth cleaning elements 140 assists in retention, of dentifrice and maintaining dentifrice in the distal cleaning surface 120 of the head 104.

Figure 4:
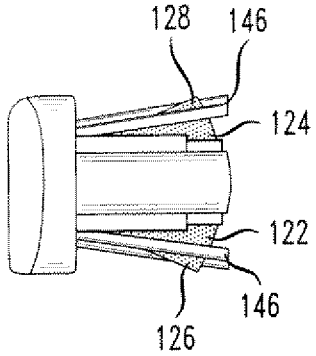
FIG. 4 is a left side view of the oral care implement shown in FIG. 1.
Figure 5:
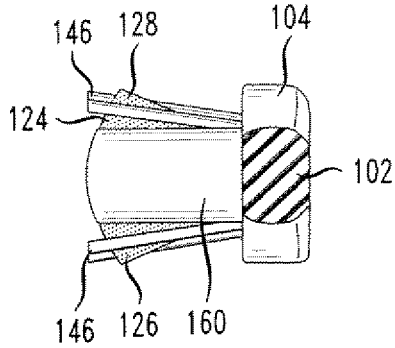
FIG. 5 is a partial right side view of the oral, care implement shown in FIG. 1.
Figure 6:
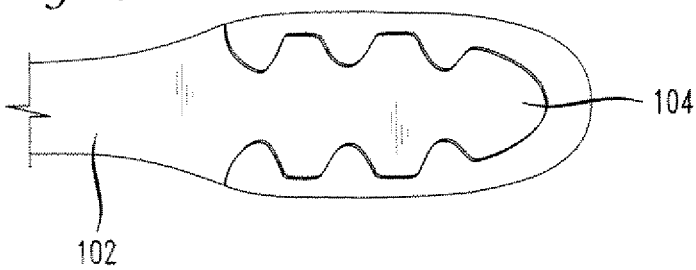
FIG. 6 is a partial bottom view of the oral care implement shown in FIG. 1.

The head 104 further supports a third tooth cleaning element 146 in the form of side tooth cleaning elements 146. In an exemplary embodiment, the side cleaning elements 146 are a plurality of side cleaning elements 146. The side cleaning elements 146 are positioned along the first peripheral side 110 of the head 104 and the second peripheral side 112 of the head 104. The side tooth cleaning elements 146 are further positioned between the first tooth cleaning elements 122 and certain side cleaning elements 146 confront the central tooth cleaning elements 140. As further shown, the distal ends of the side tooth cleaning elements 146 may have a tapered configuration. As shown in FIGS. 4 and 5, ends 126, 128 of the first tooth cleaning elements 122 extend beyond the side cleaning elements 146.

As further shown in FIGS. 1-3, the head 104 supports a prophy cup structure 150. The prophy cup structure 150 is generally at the distal end 116 of the head 104. The prophy cup structure 150 generally has a plurality of arcuate members 152 positioned in spaced relation and forming a generally circular configuration. The prophy cup structure 150 further has a plurality of radial members 154 that extend through the spaces maintained between the arcuate members. The radial members 154 may be in the form of solid elastomeric walls and the arcuate members 152 may be in the form of curved bristle tufts. Other configurations are also possible. The prophy cup structure assists in holding and directing dentifrice towards the distal cleaning surface 120 of the head 104.

The head 104 further supports a curved tooth cleaning element 160 at the proximal end 118 of the head. The curved tooth cleaning element 160 has a generally U-shaped configuration facing towards the distal end 116 of the head 104. In one construction, the curved tooth cleaning element 160 has a pair of tooth cleaning elements 160 that are in spaced relation. The curved tooth cleaning element 160 may be in the form of a solid elastomeric wall or a tuft of bristles.

It is understood that the structural configuration of the various tooth cleaning elements 108 can be in the form of solid elastomeric members or in the form of tufts of bristles. For example, the first tooth cleaning element 122 having the fan-shape may be in the form of tufts of bristles wherein the distal ends of the bristles are dimensioned in length to form the generally convex end surface 124. The central tooth cleaning elements 140, the side tooth cleaning elements 146, prophy cup structure 150 and curved tooth cleaning elements 160 may also be in the form of bristles. In a bristle configuration, it is understood that the bristles may be in the form of tufts of bristles wherein the bristles have substantially smaller diameters. The tuffs of bristles may be tightly packed. It is understood that the lengths of the bristles can vary as desired. The bristles, as well as the other tooth cleaning elements 108, can be attached to the support member 106 by known methods, such as being fit within recesses formed in the support member 106.

It is understood that the bristles are preferably made from nylon although other materials could be used. The bristles also preferably have a generally circular cross-sectional shape, but could have other cross-sectional shapes as well. The diameter of the bristles can vary depending on the desired cleaning action of the bristles.

The structures of the tooth cleaning elements 108, alone and in cooperation, help retain and direct dentifrice towards the distal cleaning surface 120 of the head 104. This helps maintain contact of the dentifrice with the teeth and gums during brushing rather than having the dentifrice being channeled away from the teeth and gums. For example, the fan-shaped tooth cleaning elements 122, via the convex end surfaces 124, assist in directing dentifrice towards the distal cleaning surface 120 of the head 104. These tooth cleaning elements 122 further enhance interdental cleaning of teeth. The configuration of the convex end surfaces 124, being transverse to and spaced along the longitudinal axis L of the head 104 provide further brushing efficiency as more tooth and gum surface area can be covered when brushing.

These structures further provide a rolling motion over the teeth and gums during brushing. The central cleaning members 140 as well as the side tooth cleaning members 146 and the prophy cup structure 150 further help maintain and direct dentifrice towards the distal cleaning surface 120 of the head 104. Tapered distal ends of the side tooth cleaning elements 146 further improve cleaning of interproximal areas and along the gum line of a user. The curved tooth cleaning element 160 helps prevent dentifrice from passing down towards the handle 102 and away from the distal cleaning surface of the head 104. Thus, it can be appreciated that with the configuration of the various tooth cleaning elements 108, a single brush stroke provides more coverage and engagement with the teeth and gums. Because the tooth cleaning members 108 help retain and maintain dentifrice on the head 104 as well as direct dentifrice towards the distal cleaning surface 120 of the head 104, cleaning of teeth and gums and whitening of teeth is enhanced.

FIGS. 7-12 illustrate another embodiment of an oral care implement, designated with the reference numeral 200. This embodiment of the oral care implement has similar structures as the oral care implement 100 shown in FIGS. 1-6 and similar structures may be referenced with similar reference numerals.

Figure 7:
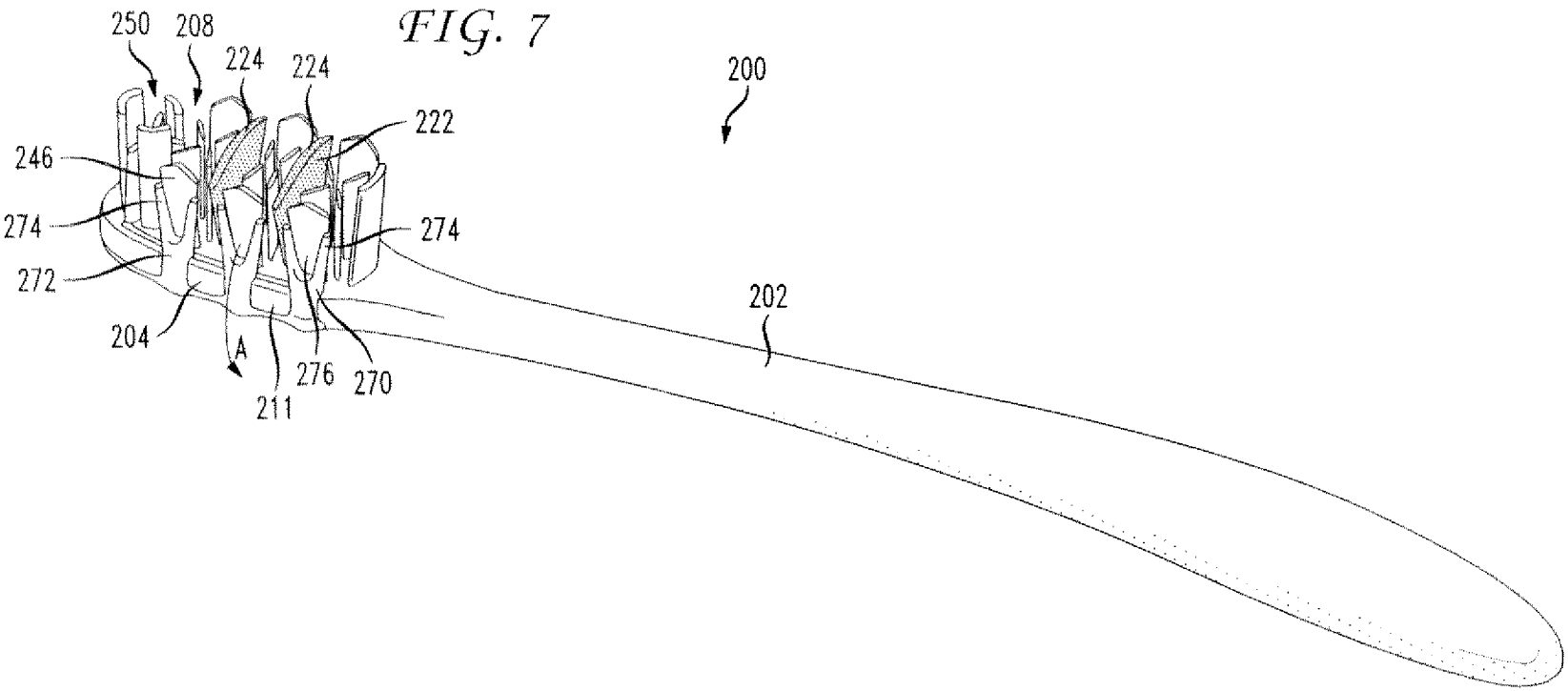
FIG. 7 is a perspective view of another oral care implement according to one or more aspects of an illustrative embodiment of the present invention.
Figure 8:
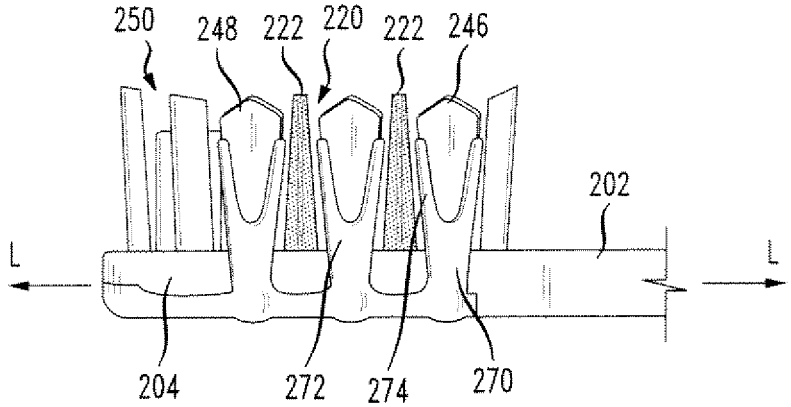
FIG. 8 is a partial front view of the oral care implement shown in FIG. 7.
Figure 9:
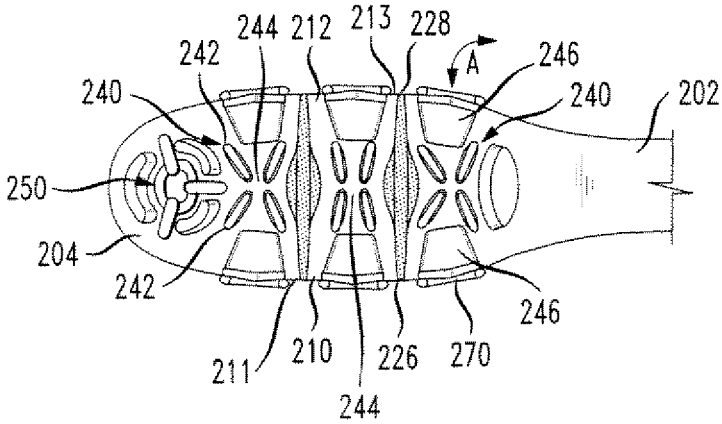
FIG. 9 is a partial top view of the oral care implement shown in FIG. 7.

As shown in FIGS. 7-9, the oral care implement 200 has a handle 202 connected to a head 204. The head 204 supports various tooth cleaning elements 208. Similar to the embodiment of FIGS. 1-6, the head 204 of the oral care implement 200 supports a first tooth cleaning element 222 having a convex end surface 224, a second or central tooth cleaning element 240, a side tooth cleaning element 246, a prophy cup structure 250 and a curved tooth cleaning element 260. Structural variations as well as additional structures will be described in greater detail below.

In the embodiment shown in FIGS. 7-12, a pair of first tooth cleaning elements 222 having convex end surfaces 224 is supported by the head 204. The first tooth cleaning elements 222 are spaced along the head 204. Three central tooth cleaning elements 240 are supported by the head 204 and are positioned adjacent or between the first tooth cleaning elements 222. In this embodiment as can be appreciated from FIGS. 10 and 11, the ends of the first tooth cleaning elements 226, 228 do not extend beyond the side tooth cleaning members 246. The central tooth cleaning elements 240 have a plurality of members 242 positioned in confronting and spaced relation. Each of the members 242 has one end that converges towards a central point 244 wherein the members generally form an X-shaped central tooth cleaning element (See e.g., FIG. 9). The angular positions of the respective members can vary as desired as can be appreciated from FIG. 9 wherein the middle central tooth cleaning element 240 has a less pronounced X-shape than the adjacent central tooth cleaning elements 240.

Similar to the previous embodiment, a plurality of side tooth cleaning elements 246 are attached to the head 204. The side tooth cleaning elements 246 are positioned along the first peripheral side 210 of the head 204 and the second peripheral side 212 of the head 204. The side tooth cleaning elements 246 generally confront the central tooth cleaning elements 240. The side tooth cleaning elements 246 are shorter in length than the side tooth cleaning elements 146 of FIGS. 1-6. The side tooth cleaning elements 246 taper at a distal end to an apex 248 (FIG. 8). The side tooth cleaning elements 246 are further resiliently deflectable.

The head 204 also supports a gum massaging element 270. In one construction, the gum massaging element 270 includes a plurality of gum massaging elements 270 positioned generally along the sides 210, 212 of the head 204. In particular, three gum massaging elements 270 are supported by a first facing surface, or first peripheral side edge 211 of the head 204 and three gum massaging elements 270 are supported by a second facing surface, or second peripheral side edge 213 of the second side of the head 204. In this exemplary embodiment, the gum massaging elements 270 extend from the peripheral side edges 211, 213 of the head 204. However, it is understood that the gum massaging elements can extend generally from a side 210, 212 of the head 204. Each gum massaging element 270 has a trunk 272 that supports a pair of spaced tines or prongs 274 that branch out from the trunk 272. A gap 276 is maintained between the tines 274. Thus, the gum massaging elements 270 may be considered to have a forked configuration. Generally, no structure is maintained in the gap 276 between the tines 274. The distal ends of the tines 274 are suitably rounded for comfortable engagement with gum tissue during brushing, which enhances stimulation of gum tissue. The gum massaging elements 270 are also semi-rigid, but have some degree of flexibility for comfort. It is understood that the gum massaging elements 270 can have different configurations including other numbers of tines 274.

Figure 10:
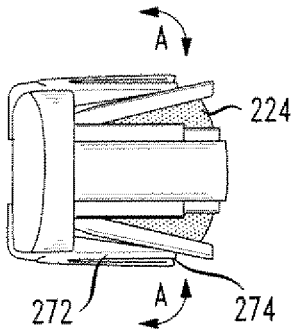
FIG. 10 is a left side view of the oral care implement shown in FIG. 7.
Figure 11:
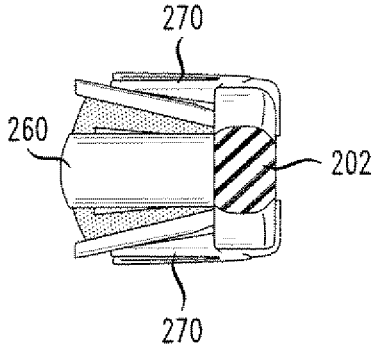
FIG. 11 is a partial right side view of the oral care implement shown in FIG. 7.
Figure 12:
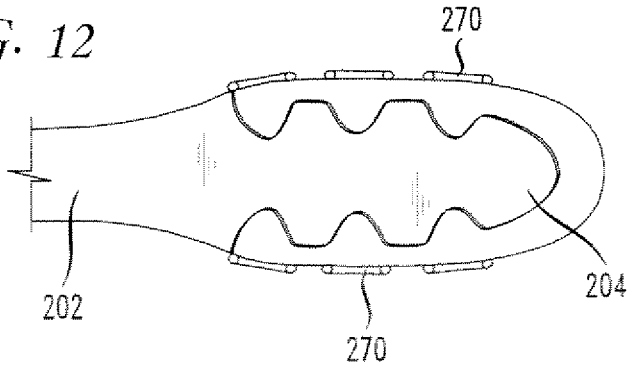
FIG. 12 is a partial bottom view of the oral care implement shown in FIG. 7.

During brushing as the various tooth cleaning elements 208 engage a user's teeth, the gum massaging elements massage the user's gums. Referring to FIGS. 7, 9 and 10, the gum massaging elements 270 further interact with the side tooth cleaning elements 246 during brushing. As shown, the side tooth cleaning elements 246 are positioned inward of the gum massaging elements 270. As indicated by the arrow A, the side tooth cleaning elements 246 may resiliently flex from a first position shown in FIGS. 7, 9 and 10, to a second position generally through the gap 276 between the tines 274. The gum massaging elements 270 prevent the side tooth cleaning elements 246 from deflecting completely over the sides of the head 204, or extreme bending in a transverse (e.g., side-to-side) direction. This structural interaction helps to maintain the side tooth cleaning elements 246 in better engagement with teeth and gums during brushing. The side tooth cleaning elements 246 are resiliently deflectable and may flex from the second position, back through the forked configuration of the gum massaging elements 270, to the first position shown in FIGS. 7, 9 and 10.

Similar to the oral care implement 100 of FIGS. 1-6, the various tooth cleaning elements 208, alone and in combination, help retain dentifrice on the head 204. These structures further help to direct dentifrice towards the distal cleaning surface 220 of the head 204. The gum massing elements 270 provide additional tissue stimulation while also interacting with the side tooth cleaning elements 246 to help maintain better engagement with the teeth and gums. Similar benefits discussed above are also equally applicable to the oral care implement 200 disclosed in FIGS. 7-12.

FIGS. 13-18 illustrate another embodiment of an oral care implement, designated with the reference numeral 300. This embodiment of the oral care implement has similar structures as the oral care implements 100, 200 shown in FIGS. 1-12 and similar structures may be referenced with similar reference numerals.

Figure 13:
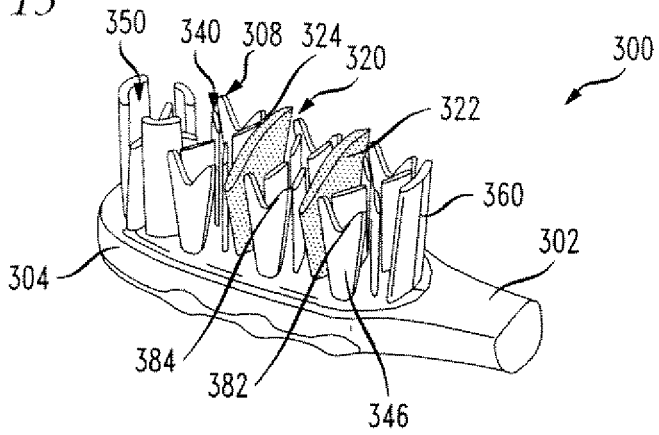
FIG. 13 is a perspective view of another oral care implement according to one or more aspects of an illustrative embodiment of the present invention.
Figure 14:
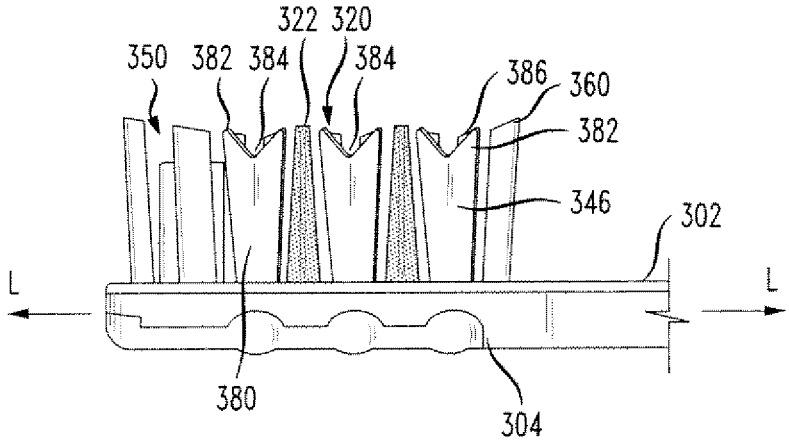
FIG. 14 is a partial front view of the oral care implement shown in FIG. 13.
Figure 15:
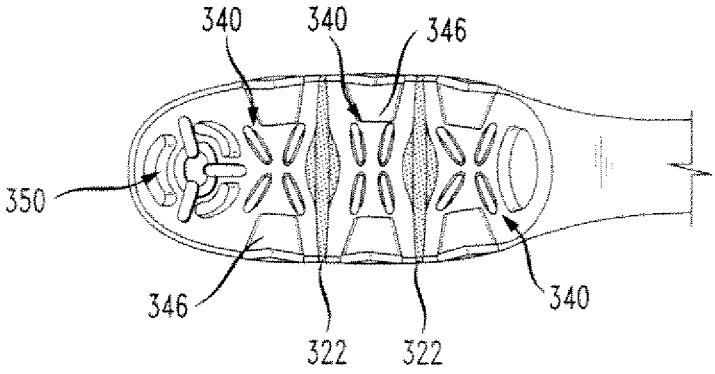
FIG. 15 is a partial top view of the oral care implement shown in FIG. 13.
Figure 16:
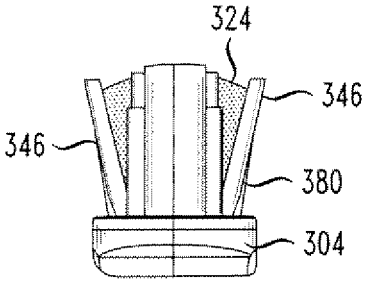
FIG. 16 is a left side view of the oral care implement shown in FIG. 13.
Figure 17:
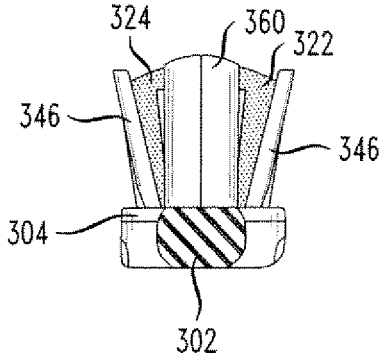
FIG. 17 is a partial right side view of the oral care implement shown in FIG. 13.
Figure 18:
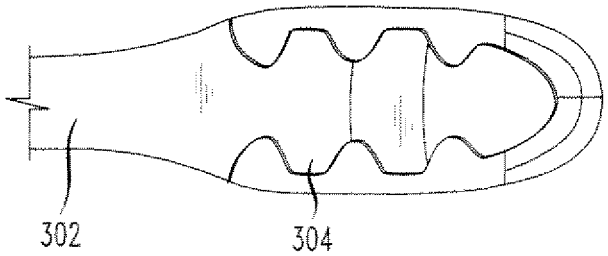
FIG. 18 is a partial bottom view of the oral care implement shown in FIG. 13.

As shown in FIGS. 13-15 the oral care implement 300 has a handle 302 connected to a head 304. The head 304 supports various tooth cleaning elements 308. Similar to the embodiment of FIGS. 1-12, the head 304 of the oral care implement 300 supports a first tooth cleaning element 322 having a convex end surface 324, a second or central tooth cleaning element 340, a side tooth cleaning element 346, a prophy cup structure 350 and a curved tooth cleaning element 360. Structural variations will be described in greater detail below.

In the embodiment shown in FIGS. 13-18, the first tooth cleaning element 322, the central tooth cleaning element 340, the prophy cup structure 350 and the curved tooth cleaning element 360 have generally similar structures as discussed above with respect to the oral care implements 100, 200 of FIGS. 1-12. Thus, for example, dentifrice applied to the head 304 will be directed to a distal cleaning surface 320 of the head 304. The more detailed description of these structures above applies to these corresponding structures shown in FIGS. 13-18.

As further shown in FIGS. 13-15, the side tooth cleaning elements 346 have different structure from the previous embodiments. The side tooth cleaning element 346 generally has a base 380 and a pair of spaced tines 382 separated by a gap 384. The base 380 is supported by the head 304. The distal ends 386 of the tines 382 are tapered and can vary in length. In one embodiment, the tines 382 are at a height below a height of the distal ends of the first tooth cleaning elements 322. Generally, the side tooth cleaning element 346 is V-shaped, or forked shaped. As shown in FIGS. 13 and 15, the side tooth cleaning element 346 is angled outwardly towards peripheral side edges of the head 304. In an exemplary embodiment, the head 304 includes a plurality of elements positioned on each side of the head 304. In a further exemplary embodiment, there are three side tooth, cleaning elements 346 on one side of the head 304 and three side tooth cleaning elements 346 on an opposite side of the head 304. It is understood that the number of tines 382 can vary as desired as well as the overall number of side tooth cleaning elements 346. The side tooth cleaning elements 346 are sufficiently flexible. The side tooth cleaning elements 346 with the spaced tines 382 are ideal for interdental cleaning. In addition, no structure is typically included between the spaced tines 382.

Figure 19:
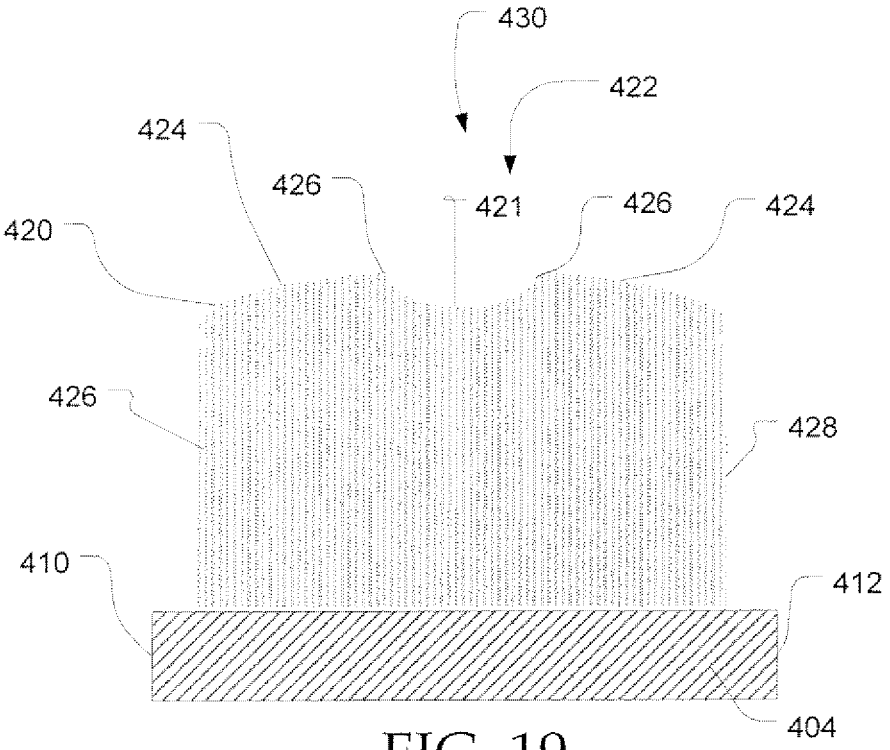
FIG. 19 is a right side cross-sectional view of a schematic representation of a tooth cleaning element and head construction according to one or more aspects of an illustrative embodiment of the present invention.
Figure 20:
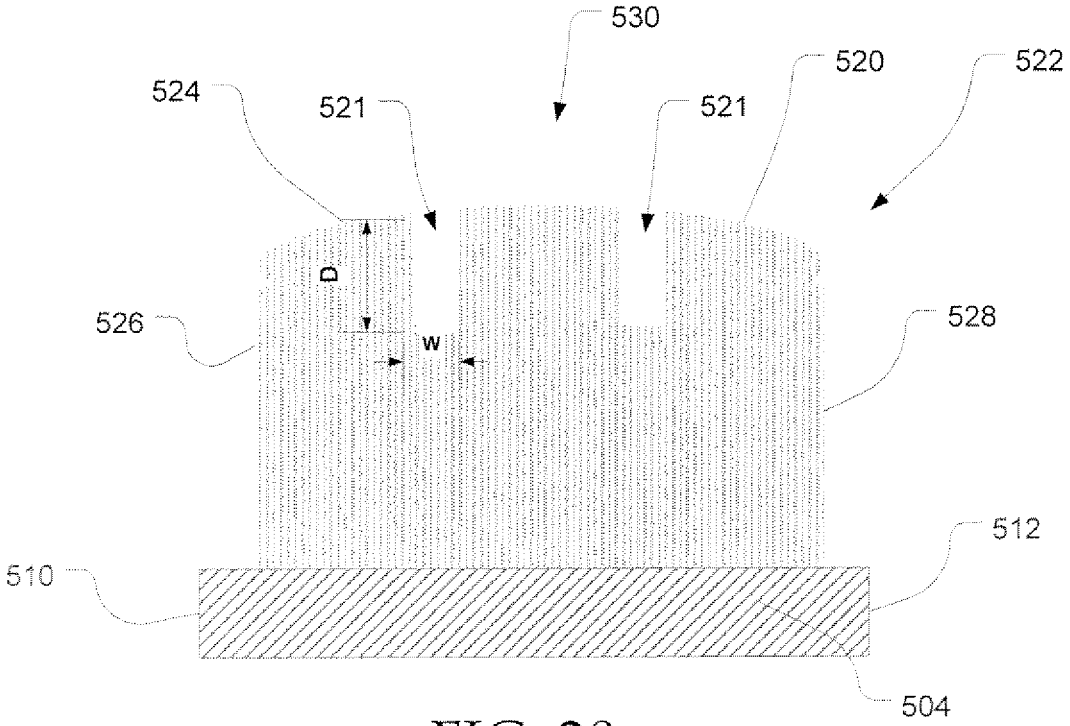
FIG. 20 is a right side cross-sectional view of a schematic representation of an alternative tooth cleaning element and head construction according to one or more aspects of an illustrative embodiment of the present invention.

FIGS. 19-20 illustrate other constructions of the first tooth cleaning element 422 and 522 for an oral care implement. These constructions of the oral care implement has similar structures as the oral care implements 100, 200, 300 shown in FIGS. 1-18 and similar structures may be referenced with similar reference numerals. Structural variations will be described in greater detail below.

In the construction shown, in FIG. 19, first tooth cleaning element 422 is generally fan-shaped. The first tooth cleaning element 422 has a generally compound arcuate end surface 424 that curves outwardly and inwardly with respect the head 404. The inward curve portion or concave region defines a basin surface or basin portion 421. The first tooth cleaning element 422 has a first side 426 proximate the first side 410 of the head 404 and a second side 428 proximate the second side 412 of the head 404. A central region 430 of the end surface 424 assists in defining the distal cleaning surface 420 of the head. The central region 430 generally represents an uppermost portion of the distal cleaning surface 420 of the head 404. The intersection of basin portion 421 and convex portions 424 defines at the apex, an interdental cleaning surface 426, that penetrates into die interproximal areas between the teeth and sweeps away the plaque and debris. In this construction, the concave nature of the distal cleaning surface 420 of cleaning elements directs the dentifrice to be retained during the sweeping or oscillating motion of the head. With the arrangement of basin portion 421, dentifrice is retained to stay longer to concentrate the contact of the dentifrice with the teeth during a brushing operation for efficient cleaning. The end surface 424 is positioned generally transverse to the longitudinal axis L shown in FIG. 2, for example. In one construction of a toothbrush, three first tooth cleaning elements 422 spaced along the head 404 and along the longitudinal axis L similarly as toothbrushes 100, 200, and 300.

In the construction shown in FIG. 20, first tooth cleaning element 522 is generally fan-shaped. The first tooth cleaning element 522 has a generally compound arcuate end surface 524 of a split nature that curves outwardly and has slit portions or basin portions 521. Portion 521 has a width W and depth D. In one arrangement, the ratio of D/W is greater than 1.0. This arrangement provides a deeper basin to retain dentifrice while enhancing interdental cleaning efficiencies of the end surface 524. Nevertheless, the ratio of D/W could be less than 1.0 to provide a larger width for receiving additional dentifrice. The first tooth cleaning element 522 has a first side 526 proximate the first side 510 of the head 504 and a second side 528 proximate the second side 512 of the head 504. A central region 530 of the end surface 524 assists in defining the distal cleaning surface 520 of the head. The central region 530 generally represents an uppermost portion of the distal cleaning surface 520 of the head 504. In this construction, the slit nature of the distal cleaning surface 520 of cleaning elements directs the dentifrice to be retained during the sweeping or oscillating motion of head. With the arrangement of basin portion 521, dentifrice is retained to stay longer to concentrate the contact of the dentifrice with the teeth during a brushing operation for efficient cleaning, in that the slit portions 521 acts as a catch basin for the dentifrice. The end surface 524 is positioned generally transverse to the longitudinal axis L shown FIG. 2, for example. In one construction of a toothbrush, three first tooth cleaning elements 522 spaced along the head 504 and along the longitudinal axis L similarly as toothbrushes 100, 200, and 300.

The toothbrushes 100, 200, 300 can be formed using a variety of manufacturing processes. Components of the toothbrushes 100, 200, 300 can be individually formed and subsequently connected. The toothbrush 100, 200, 300 is particularly suitable for cleaning elements in the form of strands or bristles attached via anchor free tufting (AFT). In the AFT toothbrush brush making process, described in detail in U.S. Pat. No. 6,779,851, nylon is fed into a pre-molded plate that can be made from any thermoplastic or elastomer material or combination thereof. This nylon may be processed into bristle tufts of various sizes and shapes. The proximal end of the nylon is heated and melted to retain the nylon in the head plate. The head plate may then be ultrasonically welded to a pre-molded handle that has a peripheral wall or frame on which the head plate will rest and become fused to the handle. In other methods, the head can be formed having an opening wherein the tooth cleaning elements are injection-molded in a further process step through the opening in the head. The second tooth cleaning element can also be pre-molded and then sonically-welded to the head. Other suitable manufacturing processes can also be utilized.

The inventive aspects may be practiced for a manual toothbrush or a powered toothbrush. In operation, the previously described features, individually and/or in any combination, improve cleaning performance of toothbrushes. These advantages are also achieved by the cleaning elements and the synergistic effects. While the various features of the toothbrush work together to achieve the advantages previously described, it is recognized that individual features and subcombinations of these features can be used to obtain some of the aforementioned advantages without the necessity to adopt all of these features. This unique combination of elements improves and enhances cleaning and teeth whitening performance of toothbrushes. It is understood that designations such as "first," "second," "third" and "fourth" are for illustrative purposes and can be interchanged.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

We claim:

1. An oral care implement comprising:

a head having a longitudinal axis; and a plurality of first tooth cleaning elements spaced along the longitudinal axis of the head, each of the plurality of first tooth cleaning elements having a base connected to the head and a distal free end surface opposite the base, the distal free end surface of each of the plurality of first tooth cleaning elements forming a convex end surface, the plurality of first tooth cleaning, elements positioned on the head so that the convex end surfaces are generally transverse to the longitudinal axis of the head;

a generally central tooth cleaning member positioned on the head, the central tooth cleaning member having a plurality of spaced members in confronting relation, the central tooth cleaning member positioned between adjacent ones of the plurality of first tooth cleaning elements, each of the plurality of spaced members angled to converge towards a central point; and a plurality of side tooth cleaning elements positioned proximate opposite sides of the head, wherein each of the plurality of side tooth cleaning elements comprises a base and a plurality of spaced tines extending from the base.

2. The oral care implement of claim 1 wherein distal ends of the tines are tapered.

3. The oral care implement of claim 1 wherein each of the plurality of side tooth cleaning elements is generally V-shaped.

4. The oral care implement of claim 1 wherein the plurality of spaced members of the central tooth cleaning member form a generally X-shape.

5. An oral care implement comprising:

a head having a longitudinal axis, at least one fan-shaped tooth cleaning element comprising a proximal end attached to the head and a distal end extending away from the head, the distal end forming a convex cleaning surface, the fan-shaped tooth cleaning element positioned on the head so that the convex cleaning surface is generally transverse to the longitudinal axis of the head;

a plurality of side tooth cleaning elements positioned on a side of the head, each of the plurality of side tooth cleaning elements comprising a base attached to the head and a plurality of spaced tines extending from the base away from the head and forming distal ends of the side tooth cleaning elements, each of the plurality of side tooth cleaning elements angled outwardly towards a peripheral side edge of the head;

wherein the plurality of side tooth cleaning elements comprises three side tooth cleaning elements positioned along one side of the head and three side tooth cleaning elements positioned along an opposite side of the head; and a central tooth cleaning element having a plurality of members arranged in confronting and spaced relation, the central tooth cleaning element positioned adjacent the fan-shaped tooth cleaning element and in between a first one of the side tooth cleaning elements positioned on the one side of the head and a second one of the side tooth cleaning elements positioned on the opposite side of the head.

* * * * *